United States Patent [19]

Coburn

[11] 4,073,222

[45] Feb. 14, 1978

[54] CONTINUOUS RUNNING MACHINES FOR PRODUCING PAPERBOARD BOX BLANKS

[75] Inventor: Robert E. Coburn, Warminster, Pa.

[73] Assignee: Molins Machine Company, Inc., Cherry Hill, N.J.

[21] Appl. No.: 687,118

[22] Filed: May 17, 1976

[51] Int. Cl.[2] ..... B31B 1/02

[52] U.S. Cl. ..... 93/36 M; 93/58.2 R

[58] Field of Search ..... 74/666 A, 666 B, 666 D, 74/666 E, 665 L, 665 M, 665 N, 665 P; 83/110, 298, 734; 93/36 M, 58 R, 58.1, 58.2 R

[56] References Cited

U.S. PATENT DOCUMENTS

| | | | |
|---|---|---|---|
| 2,289,909 | 7/1942 | Greenwood | 156/472 |
| 2,950,658 | 8/1960 | Moser et al. | 93/58 R |
| 2,985,223 | 5/1961 | Thorn | 93/58.2 R |
| 2,993,527 | 7/1961 | Moser et al. | 93/58.2 R X |

*Primary Examiner*—Roy Lake
*Assistant Examiner*—Paul A. Bell
*Attorney, Agent, or Firm*—Seidel, Gonda & Goldhammer

[57] ABSTRACT

The low speed continuous run feature of a double facer machine is attained by a discrete drive motor coupled thereto by an overrunning clutch. The main drive shaft is coupled to the double facer machine by a fluid operated clutch coupled to circuitry for the double facer machine belt tensioner so that the double facer machine may not operate unless the belt has been tensioned.

4 Claims, 4 Drawing Figures

FIG. 1
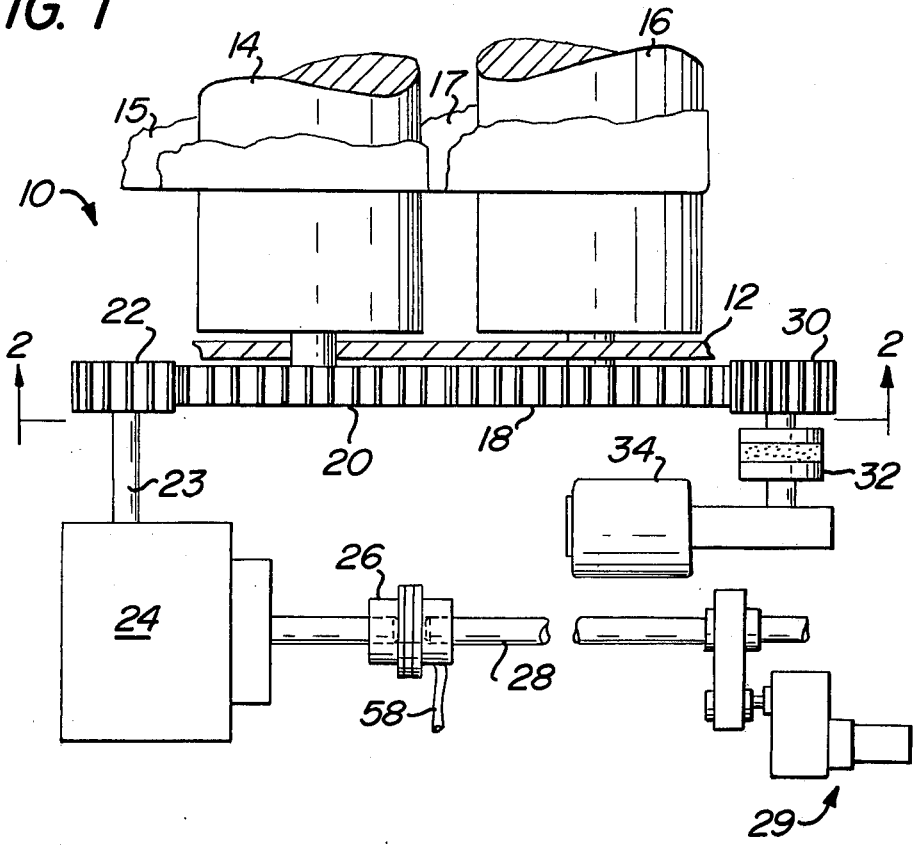
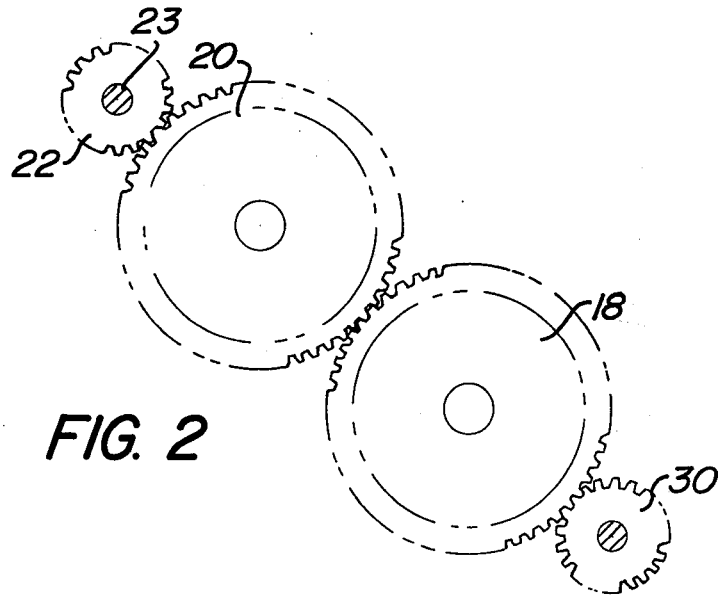
FIG. 2

CONTINUOUS RUNNING MACHINES FOR PRODUCING PAPERBOARD BOX BLANKS

BACKGROUND

It is old in the art to provide a low speed continuous run feature for a double facer machine. A double facer machine is preferably continuously operated at low speeds during adjustments of the slitter-scorer and cut-off as may be required for change over from one form or size of box blank to another at the end of a production run. In accomplishing this result, the double faced web is severed as its leaves the double facer machine and the speed of the double facer machine is then immediately reduced relative to the speed of the previously formed web so as to afford an increasing gap between the severed ends of the web. After the desired adjustments have been made to the slitter-scorer and cut-off, the speed of the double facer machine and the speed of the entire corrugator may be adjusted or increased as required. For relevant prior art, see U.S. Pat. Nos. 2,764,217 and 2,950,658.

While the prior art devices have performed satisfactorily, they have certain limitations which are overcome by the present invention. In U.S. Pat. No. 2,950,658, speed control is attained by way of the differential shown in FIG. 3 and which is expensive as well as being comprised of many components. This invention involves fewer components and attains the desired result at a substantially lesser cost. Further, the prior art lacked safety features which are provided by the present invention.

The prior art sought to use a single drive motor for driving the double facer machine in the high speed run mode and in the low speed mode. It is more efficient and less expensive to use two discrete motors, each designed to drive the double facer machine at one of the different speed modes.

SUMMARY OF THE INVENTION

The belts of a double facer machine are driven from a main drive shaft which conventionally also serves the slitter-scorer and cut-off machines. The main drive shaft is provided with a fluid operated clutch which is engaged during operation in the normal or run mode. The belts of the double facer machine are driven at a slow speed during the continuous run mode by a discrete motor coupled thereto by way of an overrunning clutch while adjustments are made to the slitter-scorer and cut-off during a change over at the end of a production run. The fluid operated clutch is connected to circuitry for the upper belt tensioner of the double facer machine so that the belt cannot be driven by the main drive shaft unless motive fluid has been transmitted to said belt tensioner.

It is an object of the present invention to provide novel apparatus and method for continuous running of a double facer machine.

It is another object of the present invention to provide safer and more reliable continuous running machines for producing paperboard box blanks.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a partial plan view of the belt rollers at the discharge end of a double facer machine.

FIG. 2 is a view taken along the line 2—2 in FIG. 1.

Figure 3:
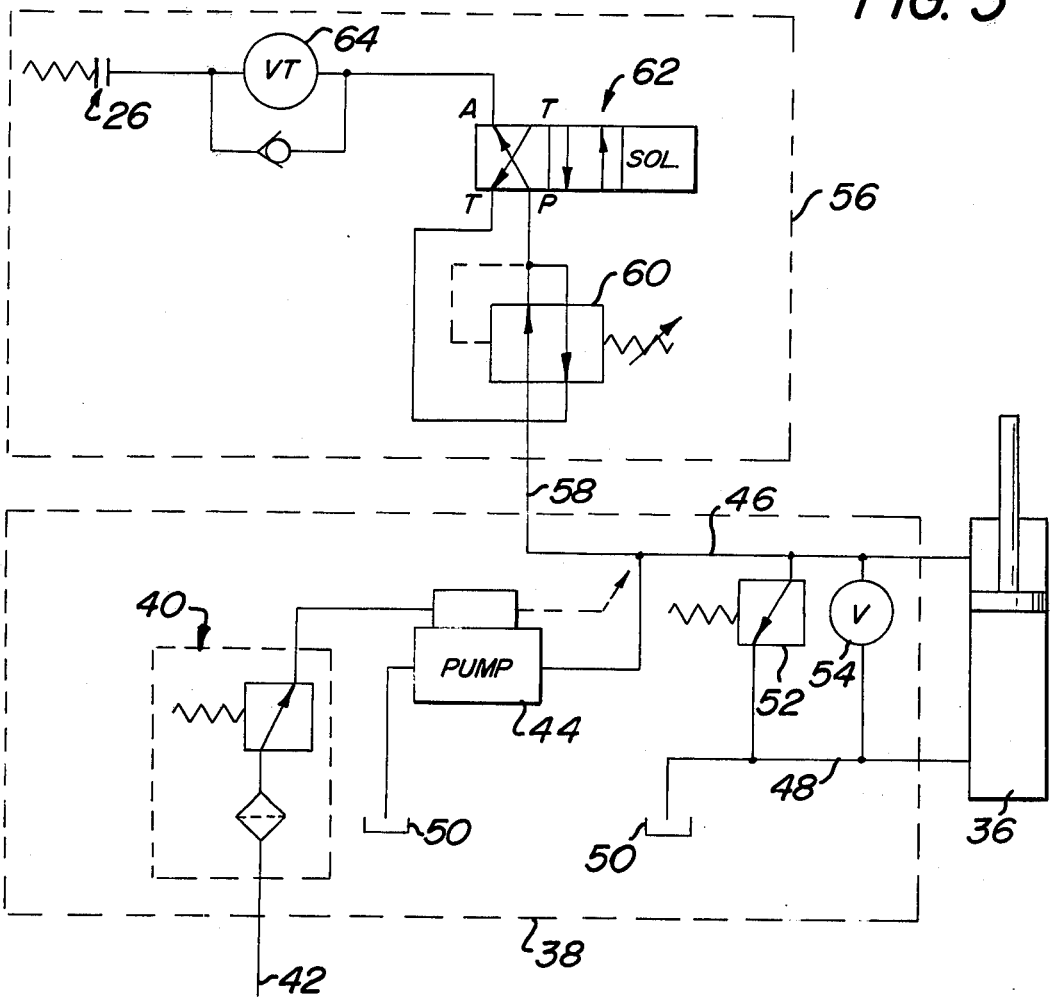
FIG. 3 is a diagrammatic illustration of circuitry.

Referring to the drawing in detail, wherein like numerals indicate like elements, there is illustrated in FIG. 1 a portion of the discharge end of a double facer machine designated generally as 10. The machine 10 includes oppositely disposed side frames. A portion of one side frame is shown in FIG. 1 and designated 12. The side frames support belt pulleys 14 and 16 which are parallel and rotate about their longitudinal axes. An upper belt 15 extends around pulley 14. A lower belt 17 extends around pulley 16. Pulley 16 is downstream from the pulley 14 and at a lower elevation.

Except as will be made clear hereinafter, the double facer machine 10 including pulleys 14, 16 and their respective belts are conventional. Pulleys 14, 16 correspond, for example, to rolls 18, 21, respectively, in U.S. Pat. No. 2,993,527.

A gear 18 is connected to pulley 16 for rotation therewith. A gear 20 is connected to pulley 14 for rotation therewith. The gears 18 and 20 are identical and are in mesh so that pulleys 14 and 16 rotate at the same speed in opposite directions.

A pinion 22 at one end of shaft 23 is meshed with gear 20. The other end of shaft 23 is connected to the gear box 24. The gear box 24 is connected to the main drive shaft 28 by a fluid operated clutch 26. The main drive shaft 28 is driven by the main drive motor 29. Main drive motor 29 is of a size such as 100 horsepower. Shaft 28 extends to and supplies the power to drive a cut-off and slitter-scorer in a conventional manner.

When adjustments are to be made to a slitter-scorer and/or the cut-off at the end of a production run, it is desirable to continuously operate the double facer machine 10 at a slow speed such that the web moves at about 40 feet per minute to prevent overheating the board. During a production mode, the web is processed at speeds in excess of 200 feet per minute. To drive the double facer machine 10 at a slow speed, there is provided a discrete auxiliary gear motor 34 of approximately 10 horsepower. The output of motor 34 is coupled to gear 18 by overrunning clutch 32 and pinion 30. When motor 34 is turned on, clutch 26 is disengaged and vice versa. Hence, the pulleys 14, 16 are alternatively driven by motors 29 or 34.

The upper belt 15 is provided with a tensioning cylinder 36. See FIG. 3. Cylinder 36 may be interrelated with the belt 15 in a conventional manner such as that illustrated in FIG. 8 of U.S. Pat. No. 2,993,527. Cylinder 36 is provided with a cylinder control circuit 38 which includes filter regulator means 40 for monitoring a motive fluid such as pressurized air supplied by conduit 42. The pressurized air is communicated to air-oil pump 44 whose output of pressurized oil is connected by conduit 46 into the tensioning side of cylinder 36.

The exhaust side of cylinder 36 communicates by way of conduit 48 to a reservoir 50. A pressure relief valve 52 is connected across conduits 46 and 48. A manual on-off valve 54 is coupled across conduits 46 and 48. When valve 54 is open, it constitutes a bypass whereby cylinder 36 is not activated and oil on the tensioning side of cylinder 36 is returned to reservoir 50. When cylinder 36 is not activated, the upper belt 15 is in a relaxed state. If the double facer machine 10 is driven by motor 29 while the upper belt 15 is in a relaxed state, belt 15 can be damaged and has a tendency to "walk" or drift across the pulley 14.

Referring to FIG. 3, conduit 46 is also coupled to clutch control circuit 56 by way of conduit 58. The other end of conduit 58 is coupled to clutch 26. Between its ends, conduit 58 is provided with a pressure reducing valve 60, a solenoid operated directional valve 62, and a flow control valve 64 in that sequence. When motive fluid is supplied to cylinder 36 to tension belt 15, motive fluid is also supplied to clutch 26. If valve 54 is open, neither clutch 26 nor cylinder 36 are operational.

As previously indicated, clutch control circuit 56 includes an adjustable pressure reducing valve 60. In the event of an emergency stop, the torque induced in decelerating the machine could damage elements of the machine. Pressure reducing valve 60, by limiting the torque the clutch 26 can apply, serves to protect the machine components from such torque overloads.

Figure 4:
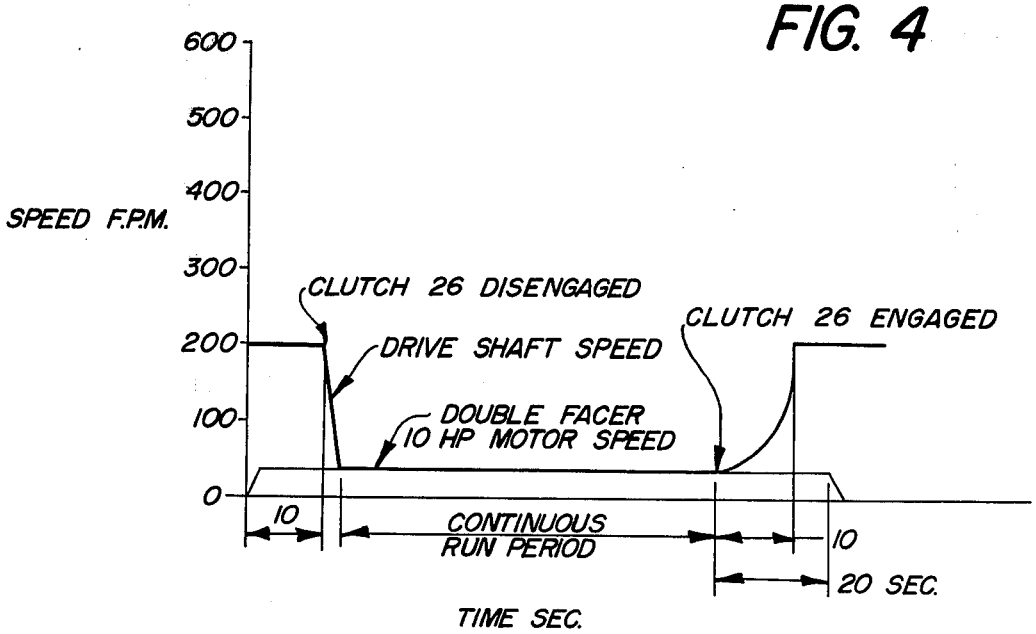
FIG. 4 is a diagrammatic chart of speed versus time in a typical application of this invention.

The following description of operation is diagrammatically illustrated in FIG. 4. Let it be assumed that a web of corrugated paperboard is being produced at the rate of 200 feet per minute. At the end of a production run, the web is severed immediately adjacent the discharge end of the double facer machine 10. Clutch 26 is simultaneously disengaged and motor 34 is started. Clutch 32 overrides above the predetermined desired speed for the web such as 40 feet per minute. Until the speed of belts 15 and 17 decrease to 40 feet per minute, motor 34 has no driving affect on the pulleys 14 and 16.

When the speed of belts 15 and 17 has decreased to 40 feet per minute, clutch 32 transmits rotary motion to pulleys 14 and 16 from motor 34 which then drives the pulleys 14 and 16 at a speed so that the web is moved 40 feet per minute for the duration of the changeover period.

When all adjustments have been completed, and it is desired to have the double facer machine 10 resume normal speed, clutch 26 is engaged by movement of the valve 62 to the position shown in FIG. 3. Gear motor 34 now being overrun through clutch 32 is shut off. The speed of the double facer machine 10 is then increased up to 200 feet per minute whereby it is then running at the same speed as the slitter-scorer and cut-off. Thereafter, those machines may be simultaneously increased to the appropriate desired speed as determined by the speed of motor 29.

When the double facer machine 10 is not in use, such as over a weekend, it is desirable to release the tension on belt 15. This is accomplished by opening valve 54. If the operator thereafter desires to start up the double facer machine, it is necessary for the operator to close valve 54. If motor 29 is running and neither clutch 26 nor cylinder 36 is activated, it is because the operator forgot to close valve 54. The interrelationship between fluid operated clutch 26 and circuitry 38 for the cylinder 36 provides a desirable safety feature.

While clutch 26 and cylinder 36 are preferably operated by a motive fluid such as oil, one or both could be operated pneumatically or electrically. The overrun speed for clutch 32 and the details thereof are optional. All of the clutches, motors and gear box are commercially available so that special assemblies such as a differential are not required. The lengths and functions of the belts 15 and 16 are conventional. A suitable clutch 26 for this apparatus is Model 800 Formsprag Disc-O-Torque clutch.

Thus, it will be seen that the present invention provides for a continuous run of the double facer machine while reducing initial cost and maintenance and provides more reliable operation with safety features not contemplated by prior art devices.

The present invention may be embodied in other specific forms without departing from the spirit or essential attributes thereof and, accordingly, reference should be made to the appended claims, rather than to the foregoing specification as indicating the scope of the invention.

It is claimed:

1. Apparatus comprising a continuous running double facer machine having at least one driven pulley for a belt, a tensioner for the belt, a main drive motor coupled to a main drive shaft, means including a first clutch coupling said shaft to said pulley to enable said motor to drive said pulley in a run mode at a first speed, and a discrete auxiliary motor coupled to said pulley by an overrunning clutch for driving said pulley in a continuous run mode at a second speed when said first clutch is disengaged and wherein said second speed is substantially slower than said first speed, said auxiliary motor being of substantially lower horsepower than said main drive motor, circuitry for controlling operation of said belt tensioner and said first clutch so that said first clutch can only be engaged when the belt tensioner is operative.

2. Apparatus in accordance with claim 1 wherein said belt tensioner is a hydraulic cylinder, said first clutch being fluid operated, a conduit means extending between said fluid operated clutch and said circuitry, said conduit means including a directional valve and a pressure reducing valve for limiting the torque of said clutch.

3. A method of providing a continuous run mode for a double facer machine during the production of corrugated paperboard box blanks comprising the steps of processing a web on a double facer machine, driving at least one belt pulley of the double facer machine by a main drive motor during a run mode at a first speed, severing the web transversely and disconnecting said main drive motor from said double facer machine substantially simultaneously, permitting the double facer machine to slow down to a second slower speed, and then driving the double facer machine at said second slower speed by a discrete auxiliary drive motor coupled to the double facer by an overrunning clutch, driving said double facer machine at said second speed while adjustments are made in connection with the machine downstream from said double facer machine, and then coupling said main drive motor to said double facer machine after the adjustments have been made to thereafter increase the speed of the double facer machine from said second speed to said first speed, and shutting off said auxiliary motor so that the double facer machine is driven solely by the main drive motor at said first speed, including coupling the main drive shaft to the double facer machine by a fluid operated clutch constituting the sole disconnectable component between the double facer machine and the main drive motor, and utilizing a motive fluid for said fluid operated clutch from the circuitry associated with a belt tensioner on the double facer machine in a manner so that the fluid operated clutch can only be engaged when the belt tensioner is operative.

4. Apparatus in accordance with claim 1 wherein said circuitry includes a valve for relieving the tension on the belt when the double facer machine is inoperative.

* * * * *